United States Patent [19]

Pon et al.

[11] Patent Number: 4,514,484

[45] Date of Patent: Apr. 30, 1985

[54] POWDER FOR DEVELOPING LATENT IMAGES AND A METHOD OF PRODUCING THE POWDER

[75] Inventors: Francois Pon, Danjoutin; Jean-Philippe Voirin, Hericourt; Andre Lucan, Belfort, all of France

[73] Assignee: Compagnie Internationale Pour L'Informatique Cii/Honeywell Bull (Societe Anonyme), Paris, France

[21] Appl. No.: 223,005

[22] Filed: Jan. 6, 1981

Related U.S. Application Data

[63] Continuation of Ser. No. 65,053, Aug. 9, 1979, abandoned.

[30] Foreign Application Priority Data

Sep. 12, 1978 [FR] France ..... 78 26113

[51] Int. Cl.[3] ..... G03G 9/14

[52] U.S. Cl. ..... 430/106.6; 430/110

[58] Field of Search ..... 430/110, 106.6

[56] References Cited

U.S. PATENT DOCUMENTS

| | | | |
|---|---|---|---|
| 3,185,777 | 5/1965 | Rheinfrank | 430/107 |
| 3,227,675 | 1/1966 | Papalos | 430/110 X |
| 3,558,492 | 1/1971 | Proskow | 430/39 X |
| 3,639,245 | 2/1972 | Nelson | 430/110 |
| 3,840,464 | 10/1974 | Van Engeland et al. | 430/110 |

*Primary Examiner*—John D. Welsh

*Attorney, Agent, or Firm*—Kerkam, Stowell, Kondracki & Clarke

[57] ABSTRACT

A powder suitable for developing latent magnetic images comprising magnetic particles coated with a mixture of a thermoplastic resin and a silane. A method for producing the said powder comprising hot-forming a mixture of magnetic particles, a thermoplastic resin and a silane, cooling and reducing the cooled mass to a fine powder.

22 Claims, No Drawings

POWDER FOR DEVELOPING LATENT IMAGES AND A METHOD OF PRODUCING THE POWDER

This application is a continuation of application Ser. No. 065,053, filed Aug. 9, 1979, abandoned.

BACKGROUND OF THE INVENTION

The present invention relates to a powder intended for developing latent images, and to a method of producing the powder.

A particular, although not exclusive, application of this powder is in the field of printing machines, termed non-impact or strikeless transfer printing machines, in which characters are printed without relying for this purpose on the impact of raised printing characters against a recipient sheet of paper, the machines being of the magnetic type in the present case.

Printing machines of this type have an image carrying member which is usually formed by a rotary drum of an endless belt on the surface of which it is possible, by magnetic means, to form sensitized zones, also termed latent images, which correspond to the characters to be printed. These latent images are then developed, that is to say rendered visible, by means of a powdered developing pigment which, when deposited on the image carrying member, is only attracted by its sensitized zones. The powdered pigment is applied by means of an applicator arrangement of a known kind in front of which the image carrying member passes. Thereafter, the particles of pigment which have been deposited on the latent images are transferred to a carrier sheet, such as a sheet of paper, for example, to which they are then permanently affixed.

The powdered developing pigments which are used in magnetic printing machines have to meet far more stringent requirements than those which are used in other non-impact printing machines. Such other machines are either (1) electro-optical machines which have an image carrying member on which surface latent images are formed by electrostatic means, the said images being developed by means of a developing pigment which is then transferred to a sheet of ordinary paper or, (2) electrostatic machines in which the latent images, instead of being formed on an image carrying member, are generated directly on a sheet of special paper which has been treated beforehand to enable it to record such latent images. Powdered developing pigments intended for magnetic non-impact printing machines in fact need to be capable not only of adhering to the magnetized zones of the image carrying member but also of being easily transferred, in their entirety, to the recipient sheet of paper with which they are subsequently brought into contact.

The pigments need to be capable of melting freely at a relatively low temperature, so that the temperature of the arrangement for affixing them to the paper can be set at a level such that there is no risk of the paper charring or catching fire. Nevertheless, the pigments must not have too low a melting point as otherwise they will be liable to soften, which will make them sticky and cause them to adhere more strongly to the image carrying member, thereby preventing their being transferred to the paper in their entirety. Furthermore, when they have not yet been melted, the pigments should not cake or become charged with static electricity, to prevent their sticking to the parts of the image carrying member which have not been magnetized. It is also necessary that the pigments not produce a disagreeable odor or dangerous vapors when they are melted. Furthermore, they must be capable of mixing properly with the coloring agents which must often be added to increase the contrast between the background shade of the paper and the color of the images formed on the paper.

It is essential that the powdered pigments have a fine particle size so that images of a good quality can be produced on the paper. In addition, the pigments, when melted, should not spread out over the paper or diffuse into it in order to prevent blurring. Nor should the pigments be affected by moisture. Finally, their properties should remain virtually unaltered with time.

The powdered developing pigments which have been used hitherto in magnetic non-impact printing machines do have some of the characteristics mentioned above. This is true for example of the powdered developing pigment which was mentioned incidentally in the French patent application published as No. 2305764, which pigment is formed from ferromagnetic materials and insulating resins. However, there is no developing pigment which possesses all of the above-named ties simultaneously.

The present invention overcomes the deficiencies of the prior art and provides a powder which, being intended for the development of magnetic images, has all of the properties mentioned above.

SUMMARY OF THE INVENTION

It is an object of the invention to provide a powder for developing latent images which comprises magnetic particles covered with a coating substance, characterized in that the said coating substance is formed by at least one organic thermoplastic resin associated with a silane.

Another object of the invention is to provide a method for producing the above developing powder, the method being characterized in that it consists in hot-forming an intimate mixture comprising from 5 to 80% by weight of magnetic particles, from 0.01 to 10% by weight of a silane, the remainder being at least one organic thermoplastic resin; and in reducing the intimate mixture so obtained to a powder after cooling.

DETAILED DESCRIPTION OF THE INVENTION

The developing powder of the present invention comprises very fine dry particles each consisting of a magnetic core covered with a coating substance. The coating substance itself is formed from at least one organic thermoplastic resin associated with a silane. The organic thermoplastic resin used has a softening point of approximately 60° C. and a melting point of the order of 120° C. It is selected from the group comprising the polyamides, the polystyrenes, the vinyl resins, the vinyl copolymers such as polyvinyl acetate, the ketone resins, and the cellulose esters. The preferred resins are the polyamide resins derived from the condensation of fatty acids and aliphatic diamines, e.g. those produced by the General Mills Company under the "Versamid" trademark. Use may also be made of the polyamide resins sold under the tradename "Polymid" by the Krumbhear Resin Division of Lawter Chemical Incorporated.

Examples of suitable polyamides include Versamid 930 and Versamid 961, Scope 30 (Societe Francaise Organo Synthe), Platamid H 104 (Ato Chimie), Terlan 1005 (T.R.L.), Reammide PFS 30 (Chemplast), and Polymid 1060.

Examples of suitable ketone resins include Resin Cetonique N (BASF), Resine Cetonique AFS (Bayer), Resine Cetonique AP and Resine Cetonique SK (Huls).

Suitable polystyrenes include Supra Pal LG and Supra Pal AP (BASF), Piccolastic D 100 and Piccolastic D 150 (Hercules).

Suitable vinyl copolymers include Copolymeres Ethylenes Acetate De Vinyle 420 (Elvax De DuPont De Nemours) and the acrylic polymers and copolymers such as Paraloid B 66 and Paraloid B 72 (Rohm and Haas), Plexigum PM 381 (Rohn and Haas) and Styrene-Acrylic Picco-Toner (Hercules).

An example of a suitable cellulose ester is Aceto Butyrate De Cellulose (Eastman Chemical).

Into this organic thermoplastic resin is incorporated a silane selected from the group of silanes having the formula:

$$R'—Si(OR)_3$$

in which R' is a group containing a reactive organic radical capable of reacting with the thermoplastic resin, and OR is an alkoxy group. In cases where the thermoplastic resin is polyamide it will, for example, be possible to use one of the silanes which are sold under the tradenames "A-1871" and "A-1100" by Union Carbide France and which have the following respective formulae:

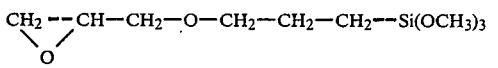

$$NH_2—CH_2—CH_2—CH_2—Si(OC_2H_5)_3$$

Also incorporated into the thermoplastic resin are magnetic particles, such as particles of magnetic iron oxide, whose size is generally less than 5 microns. It should however be mentioned that other ferromagnetic materials, such as alloys and oxides of nickel, iron, or cobalt, or ferrites, may also be used.

Various colorants, pigments or similar agents may also be incorporated in the resin.

The quantity of magnetic particles which must be added to the thermoplastic resin in order to obtain a satisfactory developing powder is from 5 to 80% of the total weight of the final powder, while the quantity of silane represents from 0.01 to 10% of its total weight. A mixture of all these ingredients is produced by heating the thermoplastic resin and the silane to obtain a melted mixture, the magnetic powder then being added to the mixture and dispersed through it. The melted mixture is then allowed to cool until it has set throughout. After this it is comminuted into particles which are sorted according to their mean dimensions of approximately 5 to 50 microns. A small quantity of polytetrafluoroethylene resin is then added to the particles of powder so obtained, this quantity being approximately 0.01 to 10% of the total weight of the final developing powder. As examples of polytetrafluoroethylene resins may be mentioned the resins which are sold under the trademarks "Soreflon 7", "Soreflon L206" or "Soreflon 81G" by Societe des Produits Chimiques Ugine-Kuhlmann. It is also possible to add powdered fluidizing agents to the dry powder particles to improve their flow characteristics. A suitable fluidizing agent may, for example, comprise the finely divided colloidal silica which is sold under the tradename "CAB-O-SIL" by the Cabot Corporation. The agent is added in a proportion of the order of 0.01 to 10% of the total weight of the final developing powder.

The following examples are given to illustrate preferred methods of producing development powders according to the invention. In these examples, which are in no way limiting, the proportions are to be understood as proportions by weight of the overall composition of the developing powder.

EXAMPLE 1

A developing powder was prepared from the following substances:

| | |
|---|---|
| "VERSAMID 961" polyamide resin | 63% |
| Magnetite sold under the tradename "NP12" by the SOFREM company | 33% |
| Union Carbide "A 1100" silane | 2% |
| Ugine-Kuhlmann "SOREFLON L206" polytetra, fluoroethylene | 1% |
| Cabot Corporation M5 grade "CAB-O-SIL" silica | 1% |

The polyamide resin, having been placed in a suitable vessel fitted with a stirrer, was heated to approximately 140° C. to melt it. After melting, the silane and the magnetic particles were added while stirring and continuing to apply heat until a homogeneous melted mixture was obtained. The melted mass was then poured into shallow dishes to form large thin sheets. These were cooled fairly rapidly to prevent the particles of magnetite from separating out from the mixture. The sheets so formed were then broken up and comminuted and reduced to fine powdered particles, using an apparatus for very fine comminution such, for example, as a high-speed rotary grinder.

The powder was then graded, for example, by means of an air screen, to separate out the particles of powder whose size was between 5 and 60 microns. The particles so separated were then mixed under dry conditions with 1% by weight of "Soreflon L206" polytetrafluoroethylene and with 1% by weight of M5 grade "CAB-O-SIL" collodial silica.

In this way a developing powder was obtained which had a coercive field of less than 400 oersteds, thereby permitting the formation of very sharp printed images in a magnetic printing operation which contrasted strongly with the background shade of the paper on which they were formed. The minimum melting temperature at which the images so obtained could be permanently affixed lay at around 120° C.

EXAMPLE 2

The operations of preparing a developing powder which are described in Example 1 were repeated, but with the following substances:

| | |
|---|---|
| "VERSAMID 961" polyamide resin | 50% |
| "NP 12" magnetite | 48% |
| Union Carbide "A 187" silane | 1% |
| "SOREFLON 81G" polytetrafluoroethylene | 0.5% |
| "AEROSIL 300" silica (registered trademark) made by the DEGUSSA company | 0.5% |

The developing powder obtained had a coercive field of the order of 350 oersteds and melted at a temperature close to 130° C. The magnetic printing images developed by means of this powder were sharp and of good quality.

EXAMPLE 3

A developing powder was prepared from the following substances:

| | |
|---|---|
| "VERSAMID 930" polyamide resin | 44% |
| "SK" ketone aldehyde resin made by the HULS company | 22% |
| "NP 12" magnetite | 33% |
| Union-Carbide "A 1100" silane | 0.25% |
| "SOREFLON L206" polytetrafluoroethylene | 0.25% |
| M5 grade "CAB-O-SIL" silica | 0.5% |

The preparatory operations were similar to those described in Example 1 except that the first step was to melt the polyamide resin and the ketone aldehyde resin together. When the two resins had melted, they were stirred to obtain a homogenized molten mixture. Thereafter, the operations of adding silane and magnetic particles, of cooling, of comminuting, and of adding polytetrafluoroethylene and colloidal silica were performed as indicated in Example 1.

A developing powder was obtained which had a coercive field of the order of 380 oersteds and which melted at a temperature in the region of 120° C.

EXAMPLE 4

A developing powder was prepared from the following substances:

| | |
|---|---|
| The polyamide resin which is sold under the tradename "SCOPE 30" by the French Organo-Synthese Company | 25% |
| The Bayer Company's "AFS" (registered trademark) ketone aldehyde resin | 25% |
| The $Fe_2O_3$, $\gamma$ iron oxide which is sold under the tradename "MAG 1730" by the Bayer Company | 35% |
| The carbon black which is sold under the tradename "RAVEN 1255" by the Columbian Carbon Company | 14.5% |
| Union-Carbide "A 186" silane | 0.05% |
| "SOREFLON 7" polytetrafluoroethylene | 0.9% |
| "AEROSIL 200" (registered trademark) silica made by the DEGUSSA company | 0.05% |

The first step was to melt the polyamide resin and the ketone aldehyde resin together and after the melting they were stirred to produce a homogeneous melted mixture. The silane, iron oxide particles, and carbon black were then added and were dispersed through the melted mixture. After cooling and comminution, the polytetrafluoroethylene and the silica were added.

The developing powder obtained had a coercive field in the region of 320 oersteds and melted at a temperature of approximately 120° C.

EXAMPLE 5

A developing powder was prepared from the following substances:

| | |
|---|---|
| The polyamide resin which is sold under the tradename "TERLAN 1005" by the T.R.L. Company | 22% |
| The HULS company's "SK" ketone aldehyde resin | 6% |
| The SOFREM company's "J 140" type $Fe_2O_3$ $\gamma$ iron oxide | 70% |
| Union Carbide "A 187" silane | 0.5% |
| "SOREFLOX L206" polytetrafluoroethylene | 1% |
| M5 grade "CAB-O-SIL" silica | 0.5% |

The developing powder was prepared as in Example 4 and had a coercive field of the order of 300 oersteds and melted at a temperature in the region of 130° C.

What is claimed is:

1. A dry powder for developing magnetic latent images formed on an image carrying member, said powder comprising finely-divided particles including from 5 to 80% by weight of a ferromagnetic material, each of said particles comprising a core of said material firmly embedded within a polymerized mixture including at least one organic thermoplastic resin which has been previously melted and hot mixed with a silane in a ratio from 0.01 to 10% by weight based on the weight of said powder.

2. A dry powder for developing magnetic latent images formed on an image carrying member as set forth in claim 1 wherein said silane is selected from the group of silanes having the formula:

$$R'—Si(OR)_3$$

in which R' is a group containing a reactive organic radical capable of reacting with the thermoplastic resin, and OR is an alkoxy group.

3. A dry powder for developing magnetic latent images formed on an image carrying member as set forth in claim 2, wherein said silane is selected from the silanes having the formula:

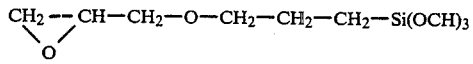

$$NH_2—CH_2—CH_2—CH_2—Si(OC_2H_5)_3$$

4. A dry powder, according to claims 1, 2, or 3, wherein the powder particles are mixed with powdered polytetrafluoroethylene the proportion of the alter being between 0.01 and 10% by weight of the final composition of the powder.

5. A dry powder according to claims 1, 2 or 3 wherein the powder particles are mixed with powdered polytetrafluoroethylene and colloidal silica, the proportion of polytetrafluoroethylene being between 0.01 and 10% by weight of the final composition of the powder and that of colloidal silica being between 0.01 and 10% by weight of said final composition.

6. A dry powder for developing magnetic latent images formed on an image carrying member as set forth in claims 1, 2 or 3 wherein said organic thermoplastic resin is selected from the group comprising polyamides, polystyrenes, vinyl resins, vinyl copolymers, ketone resins and cellulose esters.

7. A dry powder for developing magnetic latent images formed on an image carrying member as set forth in claim 6, finely-divided particles including from 5 to 80% by weight of a ferromagnetic material, each of said particles comprising a core of said magnetic material firmly embedded within a polymerized mixture including at least one organic thermoplastic resin selected from the group comprising polyamides, polystyrenes, vinyl resins, wherein said thermoplastic resin (is reacted) has been previously melted and hot mixed with a silane in a ratio of 0.01 to 10% by weight of said powder, said silane being selected from the silanes having the formula:

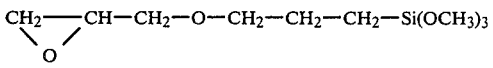

$$NH_2-CH_2-CH_2-CH_2-Si(OC_2H_5)_3$$

8. A dry powder according to claim 6 wherein the powder particles are mixed with powdered polytetrafluoroethylene and with colloidal silica, the proportion of polytetrafluoroethylene being between 0.01 and 10% by weight of the final composition of the powder, and that of colloidal silica being between 0.01 and 10% of said final composition.

9. A dry powder according to claim 7 wherein the powder particles are mixed with powdered polytetrafluoroethylene and with colloidal silica, the proportion of polytetrafluoroethylene being colloidal silica, the proportion of polytetrafluoroethylene being 0.01 to 10% by weight of the final composition of the powder, and that of colloidal silica being between 0.01 and 10% of said final composition.

10. A method of producing a dry powder for developing magnetic latent images, comprising hot forming an intimate mixture comprising from 5–80% by weight of ferromagnetic particles, from 0.01 to 10% by weight of a silane, and for the remainder at least one organic thermoplastic resin, cooling and reducing the intimate mixture so obtained to comminuted particles having a size between about from 5 to 50 microns, and mixing said comminuted particles with powdered polytetrafluoroethylene and with colloidal silica, the proportion of polytetrafluoroethylene being 0.01 and 10% by weight of the final composition of the powder and that of colloidal silica being between 0.01 and 10% by weight of said final composition.

11. A method as set forth in claim 10 wherein said intimate mixture is formed by first heating said resin to a temperature of at least, approximately 130° C. and thereafter continuing said heating and adding silane and the magnetic particles while stirring, to disperse the particles throughout the melted mixture.

12. A method as set forth in claim 11 wherein said mixture is heated to approximately 140° C.

13. A method as set forth in claim 12 wherein the melt is formed into sheets and allowed to cool to prevent particles of magnitite from separating out from the mixture.

14. A method as set forth in claim 12 wherein said sheets are reduced to fine powdered particles by subjecting the sheets to a rotary grinding action.

15. A powder as set forth in claim 1 wherein the ferromagnetic is selected from the group comprising oxides of iron, cobalt, nickel and ferrites.

16. A powder as set forth in claim 7 wherein the ferromagnetic is selected from the group comprising oxides of iron, cobalt, nickel and ferrites.

17. A method as set forth in claim 10 wherein the ferromagnetic is selected from the group comprising oxides of iron, cobalt, nickel and ferrites.

18. A powder as set forth in claim 1 wherein the particles have a coercive field of less than 400 oersteds.

19. A powder as set forth in claim 7 wherein the particles have a coercive field of less than 400 oersteds.

20. A method as set forth in claim 10 wherein the particles have a coercive field of less than 400 oersteds.

21. A powder as set forth in claims 18, 19 or 20 wherein the coercive field of the powder is approximately between 300 and 380 oersteads.

22. A powder as set forth in claim 21 which melts at a temperature about 120° C.

* * * * *

UNITED STATES PATENT AND TRADEMARK OFFICE

CERTIFICATE OF CORRECTION

PATENT NO. : 4,514,484

DATED : April 30, 1985

INVENTOR(S) : Francois PON et al.

It is certified that error appears in the above-identified patent and that said Letters Patent is hereby corrected as shown below:

Column 3, lines 30 and 31, change

"$CH_2$--CH— $CH_2$— O— $CH_2$— $CH_2$— $CH_2$--Si$(OCH_3)_3$" to

--$CH_2$— CH— $CH_2$— O— $CH_2$— $CH_2$— $CH_2$— Si$(OCH_3)_3$--;

Column 3, line 33, change

"$NH_2$--$CH_2$— $CH_2$— $CH_2$--Si$(OC_2H_5)_3$" to

--$NH_2$— $CH_2$— $CH_2$— $CH_2$— Si$(OC_2H_5)_3$--;

UNITED STATES PATENT AND TRADEMARK OFFICE

CERTIFICATE OF CORRECTION

PATENT NO. : 4,514,484

DATED : April 30, 1985

INVENTOR(S) : Francos PON et al.

It is certified that error appears in the above-identified patent and that said Letters Patent is hereby corrected as shown below:

Claim 3, column 6, lines 38-40, change

"$CH_2$--CH— $CH_2$— O— $CH_2$— $CH_2$— $CH_2$— Si(OCH)$_3$" to

--$CH_2$— CH— $CH_2$— O— $CH_2$— $CH_2$— $CH_2$— Si($OCH_3$)$_3$--;

Claim 3, column 6, line 42, change

"$NH_2$--$CH_2$— $CH_2$— $CH_2$--Si($OC_2H_5$)$_3$" to

--$NH_2$— $CH_2$— $CH_2$— $CH_2$— Si($OC_2H_5$)$_3$--.

Signed and Sealed this

*Fifteenth* Day of *October 1985*

[SEAL]

*Attest:*

*Attesting Officer*

DONALD J. QUIGG

*Commissioner of Patents and Trademarks—Designate*